United States Patent [19]

Rokutanzono et al.

[11] Patent Number: 4,957,839

[45] Date of Patent: Sep. 18, 1990

[54] ELECTROPHOTOGRAPHIC PHOTOCONDUCTOR HAVING A SILICONE RESIN CHARGE RETENTION LAYER

[75] Inventors: Takashi Rokutanzono, Numazu; Yukio Ide, Mishima; Hiroshi Nagame, Numazu; Kouichi Ohshima, Mishima; Narihito Kojima; Shinji Nosho, both of Numazu, all of Japan

[73] Assignee: Ricoh Company, Ltd., Tokyo, Japan

[21] Appl. No.: 274,352

[22] Filed: Nov. 21, 1988

Related U.S. Application Data

[63] Continuation-in-part of Ser. No. 198,865, May 26, 1988, abandoned.

[30] Foreign Application Priority Data

| | | | |
|---|---|---|---|
| May 26, 1987 | [JP] | Japan | 62-126941 |
| Nov. 18, 1987 | [JP] | Japan | 62-292680 |
| Nov. 20, 1987 | [JP] | Japan | 62-291831 |

[51] Int. Cl.[5] ..... G03G 5/10

[52] U.S. Cl. ..... 430/66; 430/67

[58] Field of Search ..... 430/58, 66, 67

[56] References Cited

U.S. PATENT DOCUMENTS

| | | | |
|---|---|---|---|
| 4,407,918 | 10/1983 | Sato | 430/54 |
| 4,426,435 | 1/1984 | Oka | 430/69 |

*Primary Examiner*—John L. Goodrow

*Attorney, Agent, or Firm*—Oblon, Spivak, McClelland, Maier & Neustadt

[57] ABSTRACT

An electrophotographic photoconductor is disclosed, which comprises an electroconductive layer, on which are formed in order, a photoconductive layer, a charge retention layer and a protective layer, optionally an adhesive layer between the charge retention layer and the protective layer, the charge retention layer comprising a silicone resin which comprises: (a) 50 wt. % to 80 wt. % of silicone and oxygen, (b) 10 wt. % to 30 wt. % of carbon, (c) 1 wt. % to 10 wt. % of hydrogen, and (d) 1 wt. % to 10 wt. % of nitrogen. The photoconductive layer may comprise an As-Se alloy, in which case, it is preferable that the amount of As be in the range of 33 wt. % to 38 wt. % and the balance thereof be Se in the As-Se alloy. Preferably the adhesive layer comprises a hardened material containing a metal alkoxide.

11 Claims, 1 Drawing Sheet

ELECTROPHOTOGRAPHIC PHOTOCONDUCTOR HAVING A SILICONE RESIN CHARGE RETENTION LAYER

The present application is a continuation-in-part of application Ser. 07/198,865, filed May 26, 1988, now abandoned.

The present invention relates to an electro-photographic photoconductor, and more particularly to an electrophotographic photoconductor comprising an electroconductive support, on which a photoconductive layer, a charge retention layer and a protective layer are successively overlaid, in which electrophotographic photoconductor an adhesive layer may be interposed between the charge retention layer and the protective layer for increasing the adhesion between the charge retention layer and the protective layer.

Conventionally, examples of photoconductors which are generally known as electrophotographic photoconductors are: (a) a photoconductor provided with a photoconductive layer which essentially consists of amorphous chalcogens such as amorphous selenium (hereinafter referred to as a-selenium), or a selenium alloy on an electroconductive substrate; (b) a photoconductor comprising an inorganic photoconductive material, for example, particles of compounds of the elements of Groups II to VI, such as zinc oxide, cadmium oxide or the like, which is dispersed in a binder; (c) a photoconductor utilizing an organic photoconductive material such as poly-N-vinylcarbazole and trinitrofluorenone or an azo pigment; and (d) a photoconductor utilizing noncrystalline silicon. At the present time one of the most highly sensitive electrophotographic photoconductors known is a selenium, photoconductor and, particularly, a Se-As ($As_2Se_3$) photoconductor. However, the following types of problems occur with the selenium type photoconductor in practical use:

(i) Because the Se layer shows through the photoconductor surface and is not protected, in actual practice, in addition to having poor durability and being subject to cuts and scratches during copy-making process, for example, by paper jam or like, white streaks are easily produced on the copy surface.

(ii) Abnormal images, such as deposition of toner on the background, or image flow are produced as a result of the adsorption of or dyeing by special chemical materials such as a developer and a cleaning agent in the copying machine used or in the environment.

(iii) In the same way, in actual practice, there is abrasion of the Se layer of the photoconductor by the copy paper, a cleaning device for the photoconductor and a development unit, and there is some concern about pollution as a result of As or Se adhering to the copy paper and being discharged.

(iv) Especially in the case for the Se-As type photoconductor, the surface resistance is not sufficiently large immediately after the vacuum deposition thereof, and if this material is used without any modification there are occasions when the charged electric potential is insufficient.

(v) The uniformity of the image, in particular the half-tone uniformity is not necessarily adequate.

(vi) When the Se photoconductive layer is not protected, the layer is chemically or physically impaired by corona charging during the charging process of the photoconductor, so that the life of the photoconductor is shortened by the corona charging.

In order to eliminate this type of drawbacks, the technology is known whereby a protective layer is provided on the surface of the photoconductor. Specifically, there have been disclosed a method wherein an organic film is provided on the surface of the photoconductor (Japanese Patent Publication 38-15446); a method wherein a film of an inorganic oxide is provided on the surface of the photoconductor (Japanese Patent Publication 43-14517); a method wherein an adhesive layer is provided on the surface of the photoconductor, and an insulating layer is then formed on the adhesive layer (Japanese Patent Publication 43-27591); and a method wherein an a-Si layer, an a-Si:N:H layer, an a-Si:O:H layer or the like is formed by means of the plasma CVD process, the optical CVD process or the like (Japanese Laid-Open Patent Applications 57-179859 and 59-58437).

However, when the protective layer has a resistivity of $10^{14}\Omega$.cm, or more, the increase of the residual potential and the accumulation thereof during the repeated use of the photoconductor are problems and the application of such a protective layer is not desirable.

As the technology to compensate for these drawbacks, there have been presented methods wherein the protective layer is used as a photoconductive layer (Japanese Patent Publications 48-38427, 43-16198, and 49-10258, and U.S. Pat. No. 2,901,348); methods wherein a charge transporting agent represented by, for example, a colorant or a Lewis acid, is added to the protective layer (Japanese Patent Publication 44-834 and Japanese Laid-Open Patent Application 53-133444); and a method wherein the resistance of the protective layer is controlled by the addition of finely-divided particles of a metal or a metal oxide (Japanese Laid-Open Patent Application 53-3338).

However, in the above cases, the protective layers absorb light so that the amount of light which reaches the photoconductive layer is decreased. As a result, the problem arises wherein the sensitivity of the photoconductor is decreased, which is known as the filter effect.

In addition, there is also a method as proposed in Japanese Laid-Open Patent Application 57-30846, wherein, by dispersing a metal oxide with an average particle diameter of 0.3 $\mu$m or less in the protective layer as a resistance control agent, the protective layer is made essentially transparent to visible light. However, there is again a major problem created, inasmuch as, depending on the selection of the material of the protective layer itself, or the selection of the material of the charge retention layer which requires the function of maintaining an electric charge and close adhesion characteristics, the image will flow in a high humid atmosphere and the resolution decreases. For example, when the charge retention layer materials disclosed in Japanese Laid-Open Patent Applications 58-60748, 58-18637, and 58-18638, are used in a highly humid atmosphere there is a tendency for the resolution to decrease.

In addition, when the protective layer is used, because of the presence of many particles with diameters in excess of 0.3 $\mu$m, absorption and scattering of visible light occurs and the sensitivity of the photoconductor decreases.

Furthermore, Japanese Laid-Open Patent Application 53-3338 discloses protective layers made of acrylic resin and polyester resin to which an electric resistivity control agent is added, and Japanese Laid-Open Patent Application 60-3638 also discloses protective layers made of thermo-setting resins, such as urethane resin, to which an electric resistivity control agent is added.

When the photoconductors with protective layers are compared with those without protective layers, many improved effects are observed. However, depending on the type of protective layer, the phenomena of reduction of the adhesion between the protective layer and the photoconductive layer, and reduction of the chargeability of the photoconductive layer are observed.

As means for improving these problems, it has been proposed that an intermediate layer for increasing the adhesion between the protective layer and the photoconductive layer, and an intermediate layer for preventing the charge injection into the protective layer be provided.

As such intermediate layers there have been disclosed an intermediate layer containing an inorganic compound as its main component (Japanese Laid-Open Patent Application 57-30843); an intermediate layer containing an organic polymer as its main component (Japanese Laid-Open Patent Application 57-30844); an intermediate layer containing an inorganic metal compound as its main component (Japanese Laid-Open Patent Applications 58-60748, 58-121643, and 58-121045). Satisfactory images are obtained when these materials are used at low humidities. However, at high humidities the phenomenon is observed whereby the resolution is decreased. This technology has not as yet succeeded in completely removing all these problems.

SUMMARY OF THE INVENTION

It is therefore a first object of the present invention to provide, with due consideration to the drawbacks of such conventional materials, an electrophotographic photoconductor which is transparent, mechanically strong, and, in particular, has high durability from being provided with a stable protective layer which protects against changes in humid environmental conditions, and is capable of yielding high quality images.

A second object of the present invention is to provide a electrophotographic photoconductor which takes advantage of the characteristics of a Se-As type photoconductor with high sensitivity, high chargeability, and high durability, including resistance to abrasion, which is capable of yielding high quality images.

A third object of the present invention is to provide an electrophotographic photoconductor which has a high degree of resistance to environmental conditions, and also which is hardly affected by toner filming or material staining.

A fourth object of the present invention is to provide an electrophotographic photoconductor wherein, after the preparation of the photoconductor, it is not necessary to provide any special additional after processing.

These objects of the present invention can be achieved by the provision of an electrophotographic photoconductor comprising an electroconductive layer, on which are formed in order, a photoconductive layer, a charge retention layer, and a protective layer, in which electrophotographic photoconductor,an adhesive layer may be interposed between the charge retention layer and the protective layer for increasing the adhesion between the two layers. As such an adhesive layer, an adhesive layer comprising a hardened material containing a metal alkoxide is preferable for use in the present invention.

More specifically, as the photoconductive layer of the photoconductor of the present invention, a material formed of particles of selenium, of particles of a selenium alloy such as Se-Te, and As-Se alloy, such as $As_2Se_3$, or of compounds of Groups II to IV elements, such as ZnO, CdS, CdSe, dispersed in a resin; or an organic photoconductive material such as polyvinylcarbazole, or a-Si may be used. The structure of the photoconductive layer is not restricted but may be a single layer, or a lamination of a charge generating layer and a charge transporting layer.

The charge retention layer of the photoconductor of the present invention is formed from a silicone resin comprising:

(a) silicone oxygen in an amount ranging from 50 wt.% to 88 wt.%;

(b) carbon in an amount ranging from 10 wt.% to 30 wt.%;

(c) hydrogen in an amount ranging from 1 wt.% to 10 wt.%;

(d) nitrogen in an amount ranging from 1 wt.% to 10 wt.%; expressed as wt.% of this charge retention layer.

As the protective layer of the photoconductor of the present invention, a layer comprising an organic polymer with addition thereto an organic or inorganic conductivity control agent may be employed.

When an adhesive layer is interposed between the charge retention layer and the protective layer, the adhesive layer comprises at least one component selected from the group consisting of (i) a hardened material containing a metal alkoxide, (ii) a hardened material of an organic metal complex, (iii) a hardened material of a silan coupling agent having an isocyanate group, and (iv) a decomposition product of silylisocyante.

DETAILED DESCRIPTION OF THE PREFERRED EMBODIMENTS

The electrophotographic photoconductor according to the present invention will now be explained with reference to the accompanying drawings.

Figure 1:
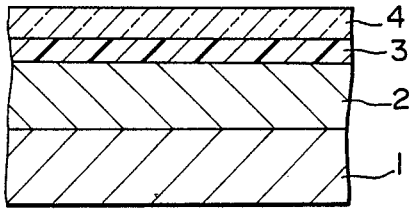
FIG. 1 is a schematic cross-sectional view of an example of an electrophotographic photoconductor according to the present invention.
Figure 2:
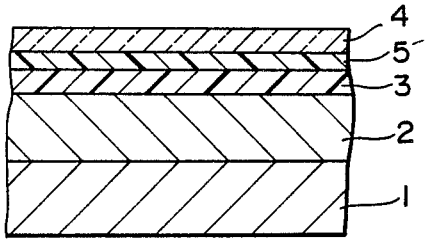
FIG. 2 is a schematic cross-sectional view of another example of an electrophotographic photoconductor according to the present invention.

FIG. 1 shows an electrophotographic photoconductor comprising an electroconductive support 1, a photoconductive layer 2, a charge retention layer 3, and a protective layer 4. In addition, as shown in FIG. 2 an adhesive layer 5 may provided between the charge retention layer 3 and the protective layer 4. Further, an undercoat layer (not shown) can be provided as required between the electroconductive support 1 and the photoconductive layer 2.

The materials, compositions, and functions of the above-mentioned layers of the photoconductor according to the present invention will now be explained.

In the present invention, as the electroconductive support 1, any electroconductive supports for use in the conventional electrophotographic photoconductors can be employed. A surface-treated material, for example, by oxidation or etching, can be used. Specifically, an electroconductive material itself and an insulating material subjected to conductive treatment can be used as the electroconductive support 1. For example, metals or alloys, such as stainless steel, Aλ, Ni, Fe, Mo, Cu, Ti, and Au; an insulating support made of, for instance, polyester, polycarbonate, polyamide, polypropylene, and glass, on which a metal such as Aλ, Ag, Au, Pb and Cu, or an electroconductive material such as $In_2O_3$ and $SnO_2$ is deposited in the form of a thin film by vacuum deposition or the like; paper subjected to electroconductive treatment; an electroconductive polymer film can be given in illustration. The electroconductive support may be in any form such as a sheet, a drum, an endless belt, and the like. Among these, a drum support of Aλ alloy, which is strong, heat-resistant (substrate temperatures reach or exceed 200° C. during deposition), machinable, and economical, is ideal.

As mentioned previously, as the photoconductive layer of the photoconductor of the present invention, a material formed of particles of selenium, of particles of a selenium alloy such as Se-Te, and $As_2Se_3$ or of compounds of the Groups II to IV elements, such as ZnO, CdS, CdSe, dispersed in a resin; or an organic photoconductive material such as polyvinylcarbazole, or a-Si may be used. The structure of the photoconductive layer is not restricted but may be a single layer, or a lamination of a charge generating layer and a charge transporting layer.

When the photoconductive layer of the photoconductor of the present invention consists essentially of Se-As, it may comprise As and Se atoms in the range of 0.1 to 45 wt.% of As and 55 to 99 wt.% of Se. This photoconductive layer may also contain one, or two, or more than two types of elements as additives such as halogen, Te, Sb, and Bi.

In particular, in a photoconductive layer mainly comprising an As-Se alloy of the formula $As_x Se_{100-x}$, it is preferable that x range from 33 wt.% to 38 wt.% for minimizing the light fatigue thereof. If this composition is used, the glass transition temperature (Tg) is about 150° C. or more, and the crystallization temperature is about 300° C. or more. During the formation of the charge retention layer 3 and the protective layer 4, the photoconductive layer 2 must be capable of adequately resisting the required heat treatment (100 to 150° C). When necessary, a foreign material such as oxygen, chlorine, and iodine may be contained in the photoconductive layer 2 as required.

The photoconductive layer 2 is usually prepared by the vacuum deposition method. It is preferable that the thickness of the photoconductive layer range from 10 μm to 100 μm, more preferably in the range of 30 μm to 70 μm. As a method of preparing the photoconductive layer 2, an alloy with the above-mentioned composition is evaporated from a single vacuum evaporation source or each element is simultaneously evaporated from a plurality of vacuum evaporation sources.

The charge retention layer 3 is formed on the photoconductive layer 2. More Specifically, it is desirable that the charge retention layer 3 be formed by applying, drying, and curing a material formed as an n-type electrical barrier layer on a p-type As-Se photoconductive layer from the chemical action of the surface layer of the As-Se photoconductive layer 2. By the formation of an n-type electrical barrier layer on a p-type As-Se photoconductive layer, when positively charged, the injection of the positive charge into the photoconductive layer is prevented, so that an ideal design is possible by which there is no accumulation of residual potential because the photo-carrier (electrons) generated throughout the photoconductive layer smoothly neutralizes the charge during the exposure to light of the photoconductive layer.

In addition, by the formation of the charge retention layer 3 extending uniformly over the entire surface of the photoconductive layer 2, the conventional application of a special charge characteristic stabilizing process, such as is required with the As-Se type photoconductor, becomes unnecessary in practice.

The following explanation outlines why it is desirable in forming the charge retention layer 3 from the chemical action of the photoconductive layer 2 that a specific silicone resin be used.

Specifically, one example of the silicone resin used in the present invention is a composition of which the main components are:

(1) a polysiloxane containing alkoxyl groups (2) a polysiloxane containing hydroxy groups, and (3) an organic silicone compound comprising (i) at least one group selected consisting of an amino group, an imino group and a nitrile group, each group bonded to a carbon atom, and (ii) a silicone atom to which two or three alkoxyl groups are bonded.

This silicone resin composition is dissolved in an appropriate solvent such as n-butanol, ligroin, toluene, and hexane to form a solution which is applied to the As-Se photoconductive layer 2 and then dried or cured by application of heat thereto, whereby a charge retention layer 3 can be formed on the photoconductive layer 2.

It is preferable that silicone resin in the cured charge retention layer 3 comprise Si, O, C, H and N in the amounts of (a) Si and O in 50 wt.% to 88 wt.%, (b) C in 10 wt.% to 30 wt.%, (c) H in 1 wt.% to 10 wt.%, and (d) N in 1 wt.% to 10 wt.%.

For this purpose, it is necessary to suitably adjust the ratios of the above-mentioned components (a), (b), and (c).

The total film thickness of the charge retention layer 3 (including an interface boundary layer) can be arbitrarily established, but is it preferable to have a layer of about 5 μm or less, more preferably 1 μm or less, or an optimum of 0.01 to 0.5 μm. The charge retention layer 3 can be formed by an immersion method or a spray method.

A barrier layer formed close to the boundary of the As-Se photoconductive layer 2 and the charge retention layer 3 is inferred to be $AS_2O_3$, $As_2O_5$, or compounds closely resembling them, from the analytical results by ESCA, FT-1R or the like. The thickness of this barrier layer is considered to be in the range of about 0.005 to 0.1 μm.

The silicone resin used in the present invention does not only have extremely favorable characteristics for forming the charge retention layer 3, by it also exhibits superior performance in adhering to the As-Se photoconductive layer 2 as a result of the previously outlined chemical action.

The properties required for the protective layer 4 of the present invention are as follows:

(1) A high degree of resistance to abrasion (2) A high degree of light transmission in the effective wave length region (3) During charging, rapid transfer of the electric charge supplied from the surface to the charge retention layer 3 (charge transfer function)

(4) A high degree of resistance to solvents (5) A high degree of resistance to environmental conditions (there should especially be no problem with image flow occurring in high humidity).

With respect to items (2) and (3) above, their objectives are achieved by dispersing a proper amount of finely-divided particles of $SnO_2$ throughout a polymer resin.

It is possible to provide a substantially transparent protective layer using finely-divided particles of $SnO_2$ which after dispersion have an average particle diameter of about 0.5 μm or less, and preferably about 0.3 μm or less.

In addition, in order that the electric charge be rapidly transferred, it is preferable that the specific resistivity of the protective layer 4 be about $10^{13}\Omega$.cm or less, and more preferably about $10^{12}\Omega$.cm or less. However, to satisfy these conditions it is necessary that the amount of $SnO_2$ dispersed be about 45 wt.% or more with respect to the entire protective layer 4, and more preferably 55 wt.% or more.

On the other hand, if the amount of $SnO_2$ dispersed is too great, the resistance of the protective layer 4 becomes too low, and the charge flows in the lateral direction so that the resolution decreases and image flow occurs.

In order to prevent this phenomenon, it is desirable that the resistivity of the protective layer 4 be $10^{8}\Omega$.cm or more, and more desirably $10^{10}\Omega$.cm or more. Accordingly, the amount of $SnO_2$ dispersed corresponds to 45 to 75 wt.% of the total protective layer 4, and preferably 55 to 65 wt.%

With respect to items (1), (4) and (5) above, these objectives can all be achieved by using as a binder a resin which is formed by a reaction between (i) a copolymer of styrene - methyl methacrylate and 2-hydroxyethyl methacrylate in which the content of the 2-hydroxyethyl methacrylate is in the range of 15 to 45 wt.%, and (ii) an isocyanate compound. The ratio of styrene to methyl methacrylate in the copolymer is not particularly restricted, but a styrene/methyl methacrylate (molar ratio) of 6/4 to 2/8 gives comparatively good results with respect to the phenomenon of image flow under conditions of high humidity.

When an isocyanate is blended into this type of copolymer resin, the ratio of the number of isocyanate groups to the number of hydroxyl groups contained in the copolymer resin is normally 0.5 to 1.5, and preferably 0.8 to 1.2.

Examples of isocyanate compounds used in the present invention are diisocyanate monomers, which may be aliphatic diisocyanates such as hexamethylene diisocyanate [HMDI], lysine diisocyanate [LDI], trimethylhexamethylene diisocyanate [TMDI], and dimer diisocyanate [DDI]; cyclic aliphatic diisocyanates such as 4,4'-methylene-bis (cyclohexyl isocyanate) [hydrogenerated MDI], methyleyyelohexane-2,4 (2,6) diisocyanate [hydrogenarated TDI], 1,3-(isocyanate methyl)cyclohexane [hydrogenerted XDI]; and aromatic diisocyanates such as xylylene diisocyanate [XDI], metaxylylene diisocyanate [MXDI], and isophorone diisocyanate [IPDI].

Polyisocyanates which are formed by reacting the above isocyanate compounds with polyhydric alcohols can also be used. In addition, depending on the object, modified polyisocyanates may also be used.

In addition, the following polyisocyanates HMDI.TMP and IPDI.TMP prepared by reacting trimethylol propane as a polyhydric alcohol with HMDI and hydrogenerated IPDI can be employed.

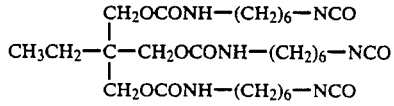

HMDI.TMP

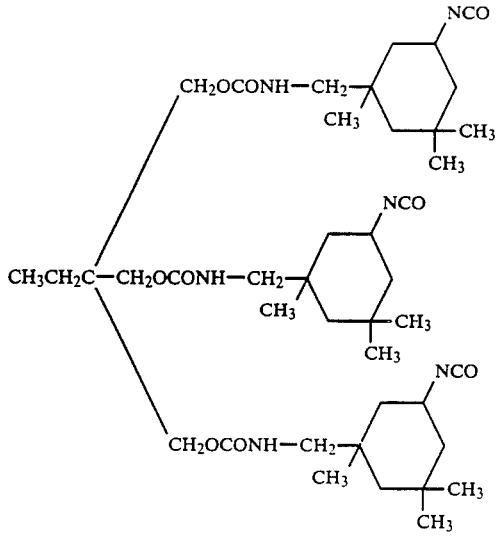

IPDI.TMP

In the same way, an isocyanate polymer which can be given is, for example, the following addition compound of 13 moles of HMDI and one mole of $H_2O$:

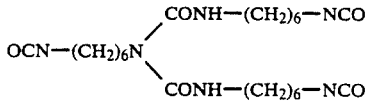

HMDI.Water (Biuret)

The following uretodion and isocyanurate may also be employed:

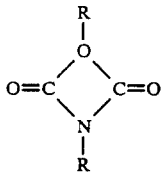

Uretorion (Dimer)

(wherein R represents an isocyanate monomer moiety.)

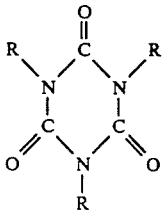

Isocyanurate (Trimer)

(wherein R represents an isocyanate monomer moiety.)

Specific examples of the above are the following HMDI isocyanurate and IPDI isocyanurate:

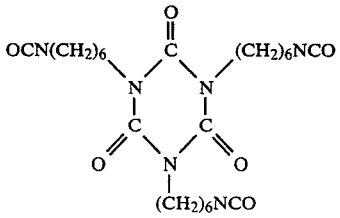

MHDI Isocyanurate

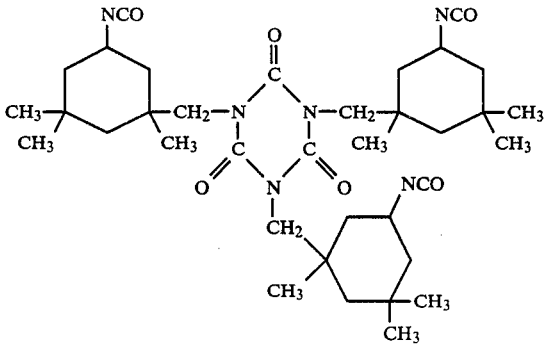

IPDI Isocyanurate

It is preferable that the number average molecular weights of these copolymer resin range from 2,000 to 200,000, and more preferably from 10,000 to 40,000.

As a protective layer used in the present invention, in addition to the above organic polymers, organic polymers to which have been added suitable amounts of organic or inorganic electroconductivity control agents can be used. Specifically, organic conductivity control agents such as anionic, cationic and nonionic organic electrolytes, and inorganic conductivity control agents such as gold, silver, copper, nickel, and aluminum, metal oxides, such as zine oxide, titanium oxide, tin oxide, indium oxide, tin oxide containing antimony oxide, tin oxide containing indium oxide, and mixtures of these compounds, can be used.

The thickness of the protective layer, from the aspect of mechanical strength and abrasion resistance of the protective layer is preferably 0.5 to 30 $\mu$m, or, more preferably, 1 to 10 $\mu$m.

The protective layer 3 can be formed on the photoconductive layer 2 by blending or dispersing an electric resistance control agent in any of the above silicone resins, and then applying a coating liquid of the resin to the photoconductive layer 2 by dipping or spraying, or by forming the protective layer 3 into a film and applying the film to the photoconductive layer 2 by use of an adhesive agent.

The specific resistivity of the protective layer, from the aspect of the charge retention performance, the residual potential of the photoconductive layer, and toner deposition on non-image areas on the photoconductive layer, is preferably $1\times10^{10}$ to $1\times10^{14}\Omega$.cm, or, more preferably, $1\times10^{11}$ to $1\times10^{12}\Omega$.cm.

In the case where the resins used in the protective layer 4 of the present invention are cross-linked polyurethane, or styrene (St) - methyl methacrylate (MMA), it is preferable that an adhesive layer 5 be provided, from the aspect of restricting the solvent used and the wettability of the silicone resin in the charge retention layer 3.

As the materials for the adhesive layer 5 of the photoconductor of the present invention, (i) a hardened material containing a metal alkoxide, (ii) a hardened material of an organic metal complex, (iii) a hardened material of a silan coupling agent having an isocyanate group, and (iv) a decomposition product of silylisocyante can be employed as mentioned previously.

Of the above-mentioned materials for the adhesive layer 5, the metal alkoxide compound is particularly preferable for use in the adhesive layer 5 in the sense that the adhesive power is great and side effects are not produced with respect to electrostatic characteristics, image quality, and environment.

There are no particular restrictions as to the metal alkoxides used for the adhesive layer 5. For example, tetramethoxy silane, tetraethoxy silane, tetrapropoxy silane, tetrabutoxy silane, tetraethoxy titanium, tetrapropoxy titanium, tetrabutoxy titanium, tetraethoxy zirconium, tetrapropoxy zirconium, tetrabutoxy zirconium, triethoxy aluminum, tripropoxy aluminum, tributoxy aluminum, triethoxy vanadium, tripropoxy vanadium, and tributoxy vanadium can be used. These metal alkoxides can be used individually or in combination.

As the organic metal complex, for example, zirconium tetrakisacetylacetonate, aluminum trisacetylacetonate, cobalt bisacetylacetonatc, magnesium bisacetylacetonate, tin bisacetylacetonate, and titanium acetylacetonate can be used.

As the silan coupling agent having an isocyanate group, for example, isocyanate propyltrimethoxy silane, isocyanate propyltriethoxy silane, isocyanate propylmethyldimethoxy silane, and isocyanate propylmethyldiethoxy silane can be employed.

The above-mentioned adhesive layer forming materials are dissolved in a suitable solvent such as ligroin and hexane, and the resulting solution is coated on the charge retention layer, followed by hardening by application of heat.

In addition, silylisocyanate compounds having the following chemical formulae in which R represents a functional group are also generally employed for the purpose of forming the adhesive layer:

(1) alkoxysilylisocyanate type $RnSi(NCO)_{4-n}$ and its condensation products, (2) alkoxysilaneisocyanate type $(RO)_nSi(NCO)_{4-n}$ and its condensation products, and (3) tetraisocyanate type $Si(NCO)_4$ and its condensation products.

In the above formulae, n is an integer of from 1 to 3, and R represents any of the following functional groups:

Hydrocarbon group: methyl group, ethyl group, butyl group, octyl group, octadecyl group, phenyl group, benzyl group, etc.

Unsaturated group: vinyl group, acryl group, allyl group, methacryl group, etc.

Alkoxyl group: ethoxy group, propoxy group, phenoxy group, etc.

Specific examples of the above silylisocyanate compounds are trimethylsilylisocyanate, dimethylsilylisocyanate, methylsilylisocyanate, vinylsilylisocyanate, phenylsilylisocyanate, tetraisocyanatesilane, ethoxysilane triisocyanate. These silylisocyanates can be used alone or in combination.

To form the adhesive layer 5, any of the above silylisocyanates is dissolved in an appropriate solvent such as n-butyl acetate to form a solution which is applied to the charge retention layer 3 and then cured by application of heat.

It is preferable that the thickness of the adhesive layer 5 be 0.1 μm or less, more preferably in the range of 0.005 μm to 0.05 μm.

The features of this invention will become apparent in the course of the following description of exemplary embodiments, which are given for illustration of the invention and are not intended to be limiting thereof.

EXAMPLE 1—1

A drum made of aluminum (80 mm diam.×340 mm length) was subjected to pre-treatment for cleaning, after which it was set in a vacuum evaporation device and an $As_2Se_3$ alloy was deposited onto the surface of the aluminum drum under the following conditions, whereby a photoconductive layer with a thickness of 60 μm was formed on the aluminum drum.

| | |
|---|---|
| Vacuum degree | $3 \times 10^{-6}$ Torr |
| Substrate (Al drum) temperature | 200° C. |
| Vacuum evaporation boat temperature | 450° C. |

A charge retention layer coating liquid was prepared, which comprised a ligroin solution (solid components: 5 wt.%) of a silicone resin (Trademark "AY 42-441" made by Toray Silicone Co., Ltd.) with the main components thereof being (i) a polyxiloxane containing alkoxyl groups, (ii) a polysiloxane containing hydroxyl groups, and (ii) an organic sllicone compound having at least one amino group bonded to carbon atom, and silicone atoms to which two to three alkoxyl groups are bonded.

The above charge retention layer coating liquid was applied and dried at 100° C. for 2 hours, whereby a charge retention layer with a thickness of 0.2 μm was formed on the photoconductive layer.

A protective layer coating liquid was prepared by adding 30 parts by weight of a styrene - methacrylic acid -acrylic acid - N-methylol acrylamide resin liquid (solid components: 40 wt.%), and 10 parts by weight of a tin oxide powder containing 10 wt.% of antimony oxide to a mixed solvent consisting of 20 parts by weight of toluene and 2 parts by weight of n-butanol, dispersing the mixture for 72 hours in a ball mill.

The thus prepared protective layer coating liquid was applied to the charge retention layer by dipping the charge retention layer into the protective layer coating liquid, and drying the applied protective layer coating liquid at 120° C. for 30 minutes, whereby a protective layer about 5 μm thick was formed on the charge retention layer. Thus, an electrophotographic photoconductor No. 1—1 according to the present invention was prepared.

An elemental analysis of the composition of the charge retention layer of the photoconductor indicated as follows:

Si and O ..... 67.8 wt.%

C ..... 22.7 wt.%

H ..... 5.8 wt.%

N ..... 3.7 wt.%

COMPARATIVE EXAMPLE 1—1

Example 1—1 was repeated except that the composition of the charge retention layer coating liquid employed in Example 1—1 was replaced by a charge retention layer coating liquid with the following formulation, whereby a comparative electrophotographic photoconductor No. 1—1 was prepared.

| | Parts by Weight |
|---|---|
| Zirconium acetyl acetonate | 2 |
| -methacryloxy propyl trimethoxy silane (Trademark "KBM 503" made by Shin-Etsu Chemical Co., Ltd.) | 1 |
| n-butanol | 40 |

The electrophotographic photoconductor No. 1—1 according to the present invention and the comparative electrophoto-graphic photoconductor No. 1—1 were charged at +6 kV and exposed to light at 11.5 μW/cm², so that the surface potential of each photoconductor was elevated to 1000 V and was then decreased to 200 V to compare the photosensitivities (μJ/cm²) of the two photoconductors.

The result was that the photosensitivity of the electrophotographic photoconductor No. 1—1 according to the present invention was 2.0 μJ/cm², while the photosensitivity of the comparative photoconductor No. 1—1 was 2.5 μJ/cm², indicating that the photosensitivity of the electrophotographic photoconductor No. 1—1 according to the present invention is higher than that of the comparative photoconductor No. 1—1.

EXAMPLE 1-2

Example 1—1 was repeated except that the content of the solid components in the charge retention layer coating liquid (i.e., the ligroin solution) employed in Example 1—1 was changed to 3 %, whereby an electrophotographic photoconductor No. 1-2 according to the present invention was prepared.

The image characteristics of the electrophotographic photoconductor No. 1—2 according to the present invention and those of the comparative electrophotographic photoconductor No. 1—1 were evaluated. The results were as follows:

| | Resolution | |
|---|---|---|
| | 22° C., 50% RH | 30° C., 90% RH |
| Example 1-2 | 6 lines/mm | 6 lines/mm |
| Comparative Ex. 1-1 | 6 lines/mm | 4 lines/mm |

As indicated above, both the electrophotographic photoconductor No. 1-2 according to the present invention and the comparative photoconductor No. 1—1 showed the same resolution (6 lines/mm) at room temperature and room humidity. However, at the higher temperature and higher humidity, the electrophotographic photoconductor No. 2 according to the present invention maintained the same resolution as that at room temperature and room humidity, while the comparative photoconductor No. 1—1 was unable to maintain the resolution, but it was decreased to 4 lines/mm, so that the comparative photoconductor No. 1—1 yielded conspicuous spread images.

The electrophotographic photoconductor No. 1-2 according to the present invention was subjected to a running test of making 300,000 copies. The result was that the image characteristics were maintained throughout the running test without the formation of any abnormal images.

EXAMPLE 1-3

A photoconductive layer of $As_{35.5}Se_{64.5}$ was formed on a drum-shaped aluminum support by vacuum deposition, followed by successively forming a charge retention layer, an adhesive layer and a protective layer on the aluminum support in the following procedure, whereby an electrophotographic photoconductor No. 1-3 according to the present invention was prepared:

(1) A drum-shaped aluminum support having a diameter of 80 mm and a length of 340 mm was washed with "Perclene" (Trademark for a drycleaing composition consisting of perchloroethylene and surfactant additives) at 120° C. for 2 minutes.

(2) The aluminum drum was then subjected to an alkaline etching in a 5 wt.% aqueous solution of $Na_3PO_4$ at 80° C. for 60 seconds, and washed with water twice.

(3) The surface of the aluminum drum was dried at 80° C. and the drum was placed in a vacuum deposition chamber, which was evacuated to a pressure of $10^{-5}$ Torr.

(4) An $As_{35.5}Se_{64.5}$ alloy was deposited on the surface of the aluminum drum at 200° C. for 35 minutes, with the temperature of the vacuum deposition source of the alloy set at 400° C., whereby a photoconductive layer with a thickness of about 60 μm was formed on the aluminum drum.

(5) The same charge retention layer coating liquid as that employed in Example 1—1 was coated on the above photoconductive layer and dried at 120° C. for 1 hour, so that a charge retention layer having a thickness of about 0.2 μm was formed on the photoconductive layer.

When this charge retention layer was formed, the same charge retention layer was formed separately as a sample for the analysis of the composition thereof. An elemental analysis of the sample indicated the following results:

Si and O ..... 67 wt.%

C ..... 23 wt.%

H ..... 6 wt.%

N ..... 4 wt.%

(6) An adhesive layer coating liquid consisting of 2 parts by weight of $Ti(OC_4H_9)_4$ and 98 parts by weight ligroin was coated on the charge retention layer and dried at 120° C. for 1 hour, so that an adhesive layer having a thickness of about 0.02 μm was formed on the charge retention layer.

(7) A mixture of the following components was dispersed in a ball mill for 150 hours, whereby a mill base solution was prepared.

| | Parts by Weight |
|---|---|
| A resin solution of styrene (St) - methyl methacrylate (MMA) - 2-hydroxyethyl methacrylate (2-HEMA) copolymer (St/MMA/2-HEMA = 20/60/20 (parts by weight) dissolved in a mixed solvent of toluene, cellosolve acetate and methyl ethyl ketone | 120 (solid components) |
| Finely-divided tin oxide particles (made by Mitsubishi Metal Corporation) | 300 |
| Mixed solvent of toluene, cellosolve acetate and methyl ethyl ketone (3/4/3 parts by weight) | 850 |

To the above prepared mill base were added about 10 parts by weight of a diluted resin solution of styrene(St) - methyl methacrylate (MMA) -2-hydroxyethyl methacrylate (2-HEMA) copolymer (St/MMA/2-HEMA=20/60/20 (parts by weight)) dissolved in a mixed solvent of toluene, cellosolve acetate and methyl ethyl ketone, and an HHDI type polyisocyanate (Trademark "Sumidur HT" made by Sumitomo Bayer Urethane Co., Ltd.) in such a fashion that the weight ratio of tin oxide particles to the solid components of the resin solution was 6:4 and the molar ratio of the isocyanate group to the hydroxyl group in the copolymer was 1:1, whereby a protective layer coating liquid was prepared.

The adhesive layer formed on the charge retention layer was then dipped into the above prepared protective layer coating liquid, and the applied protective layer coating liquid was dried at 120° C. for 30 minutes, whereby a protective layer with a thickness of about 5 μm was formed on the adhesive layer.

Thus, an electrophotographic photoconductor No. 1-3 according to the present invention was prepared.

The thus prepared electrophotographic photoconductor No. 1—3 had an adequate electric resistivity for electrophotographic use ($10^{13}\Omega$.cm or more). Its chargeability was excellent. In addition, when this photoconductor was loaded into an electrophotographic copying machine for use, there were no detectable cuts or scratches in the photoconductor, and extremely good image quality was maintained after the continuous production of 100,000 copies or more. Further, the results of analysis of the As and Se content of the developer after the preparation of 100,000 copies showed that neither of these elements was present. The evaluations of the characteristics of this photoconductor are given in Table. 1. In the Table, indicates good, Δindicates normal, and X indicates unsatisfactory.

EXAMPLES 1-4 TO 1-14 AND COMPARATIVE EXAMPLES 1-2 TO 1-4

The formulation for Example 1-3 was partly changed as shown in Table 1, whereby electrophotographic photoconductors No. 1-4 through No. 1-14 according to the present invention and comparative electrophotographic photoconductors No. 1-2 through No. 1-4 were prepared. The evaluations of these electrophotographic photoconductors are also given in Table 1.

TABLE 1

| | Changed portions from the formulation for Example 1-3 | Light Fatigue | Resistance to toluene | Adhesiveness | Image flow at high humidity | Other general Image Quality |
|---|---|---|---|---|---|---|
| Example 1-3 | | ○ | ○ | ○ | ○ | ○ |
| Example 1-4 | Photoconductive Layer (As 36.5 wt. %, and Se 64.5 wt. %) | ○ | ○ | ○ | ○ | ○ |
| Example 1-5 | Charge Retention Layer (hardened) (Si and O 75 wt. %, C 17 wt. %, H 6 wt. %, and N 6 wt. %) | ○ | ○ | ○ | ○ | ○ |
| Example 1-6 | Adhesive Layer Coating Liquid ($Zr(OC_4H_9)_4$1 wt. %, and Ligroin 99 wt. %) | ○ | ○ | ○ | ○ | ○ |
| Example 1-7 | Photoconductive Layer (As 34 wt. %, and Se 66 wt. %) | ○ | ○ | ○ | ○ | ○ |
| Example 1-8 | Resin for Protective Layer (St/MMA/2-HEMA = 30/55/15) | ○ | ○ | ○ | ○ | ○ |
| Example 1-9 | Resin for Protective Layer (St/MMA/2-HEMA = 20/35/45) | ○ | ○ | ○ | ○ | ○ |
| Example 1-10 | Photoconductive Layer (As 32 wt. %, and Se 68 wt. %) | X | ○ | ○ | ○ | Δ |
| Example 1-11 | Photoconductive Layer (As 39 wt. %, and Se 41 wt. %) | X | ○ | ○ | ○ | X |
| Comparative Example 1-2 | Charge Retention Layer (hardened) (Si and O 58 wt. %, C 24 wt. %, H 7 wt. %, and N 11 wt. %) | ○ | ○ | ○ | ○ | X |
| Comparative Example 1-3 | Charge Retention Layer (hardened) (Si and O 74 wt. %, C 20 wt. %, H 6 wt. %, and N O wt. %) | ○ | ○ | ○ | ○ | X |
| Example 1-12 | No Adhesive Layer | ○ | ○ | X | ○ | X |
| Comparative Example 1-4 | Charge Retention Layer Coating Liquid (Zr acetylacetate 4 wt. %, and butarol 96 wt. %) | ○ | ○ | Δ | X | Δ |
| Example 1-13 | Resin for Protective Layer (St/MMA/2-HEMA = 30/60/10) | ○ | X | ○ | X | ○ |
| Example 1-14 | Resin for Protective Layer (St/MMA/2-HEMA = 20/30/50) | ○ | ○ | ○ | Δ~X | Δ~○ |

As outlined in the above explanation, the charge retention layer of electrophotographic photoconductors according to the present invention show superior characteristics in resisting environmental conditions in comparison with conventional charge retention layers. Further, the electrophotographic photoconductors according to the present invention have high photosensitivity, high durability, and high reliability.

In addition, the As-Se-type electrophotographic photoconductors according to the present invention, comprising an As-Se photoconductive layer, a charge retention layer, an adhesive layer, and a protective layer, shows superior durability and weather resistance, and has a sufficiently stable surface resistance immediately after preparation of the photoconductor. Clean copies are obtained without such defects as white lines occurring. Image uniformity is extremely good, and arsenic and selenium do not adhere to the copy. Also, the characteristics of the As-Se-type photoconductor are good, without a single disadvantage. Furthermore, even if the photoconductor of the present invention is directly touched by hand, the As-Se photoconductor does not change in quality or deteriorate. Therefore, it is easily handled. It is also resistant to solvents so that when toner filming or adherence of foreign material occurs, it is not only easily cleaned, but the wet-type photographic developing process can be applied as required. In addition, the image does not flow under highly humid conditions and clean copy is obtained.

EXAMPLE 2-1

A drum made of aluminum (80 mm diam.×340 mm length) was subjected to pre-treatment for cleaning, after which it was set in a vacuum evaporation device and an $As_2Se_3$ alloy was deposited on the surface of the aluminum drum under the following conditions, whereby a photoconductive layer with a thickness of 60 μm was formed on the aluminum drum.

| | |
|---|---|
| Vacuum degree | $3 \times 10^{-6}$ Torr |
| Substrate (Al drum) temperature | 200° C. |
| Vacuum evaporation boat temperature | 450° C. |

A charge retention layer coating liquid was prepared, which comprised a ligroin solution (solid components: 5 wt.%) of a silicone resin (Trademark "AY 42-441" made by Toray Silicone Co., Ltd.) with the main components thereof being (i) a polyxiloxane containing alkoxyl groups, (ii) a polysiloxane containing hydroxyl groups, and (ii) an organic silicone compound having at least one amino group bonded to carbon atom, and silicone atoms to which two to three alkoxyl groups are bonded. The above charge retention layer coating liquid was applied and dried at 120° C. for 1 hour, whereby a charge retention layer with a thickness of 0.2 μm was formed on the photoconductive layer.

An adhesive layer coating liquid was prepared by mixing the following components:

| | Parts By Weight |
|---|---|
| $Ti(OC_4H_9)_4$ (Trademark "Orgatics TA 25" commercially available from Matsumoto Trading Co., Ltd.) | 1 |
| Ligroin | 99 |

The thus prepared adhesive layer coating liquid was applied to the charge retention layer and dried at 120° C. for 1 hour for curing the applied coating liquid, whereby an adhesive layer was formed on the charge retention layer.

A protective layer coating liquid was prepared by adding 30 parts by weight of a styrene - methacrylic acid -acrylic acid - N-methylol acrylamide resin liquid (solid components: 40 wt.%), and 10 parts by weight of a tin oxide powder containing 10 wt.% of antimony oxide to a mixed solvent consisting of 20 parts by weight of toluene and 2 parts by weight of n-butane, dispersing the mixture for 72 hours in a ball mill.

The thus prepared protective layer coating liquid was applied to the adhesive layer by dip coating and the applied protective layer coating liquid was dried at 120° C. for 30 minutes, whereby a protective layer about 5 μm thick was formed on the adhesive layer. Thus, an electrophotographic photoconductor No. 2-1 according to the present invention was prepared.

An elemental analysis of the composition of the charge retention layer of the photoconductor indicated as follows:

Si and O ..... 67.8 wt

C ..... 22.7 wt.%

H ..... 5.8 wt.%

N ..... 3.7 wt.%

EXAMPLE 2—2

Example 2-1 was repeated except that the adhesive layer coating liquid employed in Example 2-1 was replaced an adheisve layer coating liquid with the following formulation, whereby an electrophotographic photoconductor No. 2—2 according to the present invention was prepared:

| | Parts by Weight |
|---|---|
| $Zr(OC_4H_9)_4$ (Trademark "Orgatics ZA 25" commercially available from Matsumoto Trading Co., Ltd.) | 1 |
| Ligroin | 99 |

EXAMPLE 2-3

Example 2-1 was repeated except that the adhesive layer coating liquid employed in Example 2-1 was replaced an adheisve layer coating liquid with the following formulation, whereby an electrophotographic photoconductor No. 2-3 according to the present invention was prepared:

| | Parts by Weight |
|---|---|
| Titanium acetylacetonate | 1 |
| Ligroin | 99 |

EXAMPLE 2-4

Example 2-1 was repeated except that the adhesive layer coating liquid employed in Example 2-1 was replaced an adheisve layer coating liquid with the following formulation, whereby an electrophotographic photoconductor No. 2-4 according to the present invention was prepared:

| | Parts by Weight |
|---|---|
| Zirconium acetylacetonate | 1 |
| Ligroin | 99 |

EXAMPLE 2-5

Example 2-1 was repeated except that the adhesive layer coating liquid employed in Example 2-1 was replaced an adhesive layer coating liquid with the following formulation, whereby an electrophotographic photoconductor No. 2-5 according to the present invention was prepared:

| | Parts by Weight |
|---|---|
| Isocyanate propyltriethoxy silane | 1 |
| Ligroin | 99 |

EXAMPLE 2-6

Example 2-1 was repeated except that the adhesive layer coating liquid employed in Example 2-1 was replaced an adheisve layer coating liquid with the following formulation, whereby an electrophotographic photoconductor No. 2-6 according to the present invention was prepared:

| | Parts by Weight |
|---|---|
| Methylsilyltriisocyanate | 1 |
| n-butyl acetate | 99 |

EXAMPLE 2-7

Example 2-1 was repeated except that the adhesive layer coating liquid employed in Example 2-1 was replaced an adheisve layer coating liquid with the following formulation, whereby an electrophotographic photoconductor No. 2-10 according to the present invention was prepared:

| | Parts by Weight |
|---|---|
| Tetrasilylisocyanate | 1 |
| n-butyl acetate | 99 |

EXAMPLE 2-1C

Example 2-1 was repeated except that the adhesive layer provided between the photoconductive layer and the charge retention layer in Example 2-1 was eliminated, whereby an electrophotographic photoconductor No. 2-1C according to the present invention was prepared, which is substantially the same as the electrophotographic photoconductor No. 1—1 according to the present invention prepared in Example 1—1.

In order to evaluate the performance of the adhesive layers employed in the electrophotographic photoconductors No. 2-1 to No. 2-7, they were compared with the electrophotographic photoconductor No. 2-1C in which no adhesive layer was provided by subjecting those photoconductors to an adhesiveness comparison test.

In the adhesive comparison test, perpendicularly intersecting parallel line-shaped scratches were made with intervals of 1 mm by a cutter in an area of 1 $cm^2$ on the surface of each sample photoconductor, so that 100 square sub-areas of 1 $mm^2$ were made in the 1 $cm^2$ area.

The thus prepared sample photoconductor was subjected to a heating cycle consisting of a first step of increasing the ambient temperature from 20° C. to 70° C. and maintaining the temperature at 70° C. for 60 minutes, a second step of decreasing the temperature to −10° C. and maintaining the temperature at −10° C. for 60 minutes, and a third step of increasing the temperature to 20° C. and maintain the temperature at 20° C. for 30 minutes. This heating cycle was repeated 10 times, 20 times and 30 times.

Before starting the above heating test, a commercially available mending tape (Scotch Tape) was applied to the above mentioned 1 $cm^2$ area on the surface of each sample photoconductor and was then gradually peeled off the sample, so that the number of the remaining 1 $mm^2$ square sub-areas in the 1 $cm^2$ area, without being peeled off the surface of the photoconductor by the mending tape, was counted.

This peel-off test was conducted after the abovementioned heating cycle was performed 10 times, 20 times and 30 times.

The results of the peel-off test are shown in Table 2. In the table, for instance, 100/100 indicates that no sub-areas were peeled off, and 83/100 indicates that 83 sub-areas remained without being peeled off the surface of the photo-conductor.

In Example 2–1C, the peel-off test was repeated four times.

TABLE 2

| No. | Heat Cycles 0 | 10 | 20 | 30 |
|---|---|---|---|---|
| Example 2-1 | 100/100 | 100/100 | 100/100 | 100/100 |
| Example 2-2 | 100/100 | 100/100 | 100/100 | 100/100 |
| Example 2-3 | 100/100 | 100/100 | 100/100 | 100/100 |
| Example 2-4 | 100/100 | 100/100 | 100/100 | 100/100 |
| Example 2-5 | 100/100 | 100/100 | 100/100 | 100/100 |
| Example 2-6 | 100/100 | 100/100 | 100/100 | 100/100 |
| Example 2-7 | 100/100 | 100/100 | 100/100 | 100/100 |
| Example 2-1C | 75/100 | 8/100 | 0/100 | 0/100 |
| | 75/100 | 11/100 | 0/100 | 0/100 |
| | 81/100 | 17/100 | 0/100 | 0/100 |
| | 83/100 | 17/100 | 0/100 | 1/100 |

What is claimed is:

1. An electrophotographic photoconductor comprising an electroconductive layer, on which are formed in order, a photoconductive layer, a charge retention layer, an adhesive layer and a protective layer, said charge retention layer comprising a silicone resin which comprises: (a) 50 wt.% to 88 wt.% of silicone and oxygen, (b) 10 wt.% to 30 wt.% of carbon, (c) 1 wt.% to 10 wt.% of hydrogen, and (d) 1 wt.% to 10 wt.% of nitrogen and wherein said adhesive layer comprises a material selected from the group consisting of (i) a hardened material containing a metal alkoxide, (ii) a hardened material of an organic metal complex, (iii) a hardened material of a silane coupling agent having an isocyanate group, and (iv) a decomposition product of silylisocyanate.

2. The electrophotographic photoconductor as claimed in claim 1, wherein said photoconductive layer comprises an As-Se alloy which comprises As and Se atoms, which are in the range of 0.1 to 45 wt.% of As, and in the range of 55 to 99.9 wt.% of Se.

3. The electrophotographic photoconductor as claimed in claim 1, wherein said photoconductive layer comprises an As-Se alloy of the formula of $As_xSe_{100-x}$, where x indicates the weight percentage of As in said As-Se alloy, and is in the range of 33 wt.% $\leqq x \leqq 38$ wt.%.

4. The electrophotographic photoconductor as claimed in claim 1, wherein said protective layer comprises a binder resin prepared by the reaction of (i) a copolymer of styrene - methyl methacrylate and 2-hydroxyethylmethacrylate, in which the content the 2-hydroxyethylmethacrylate is in the range of 15 to 45 wt.%, and (ii) an isocyanate compound, and a conductivity control agent dispersed in said binder resin.

5. The electrophotographic photoconductor as claimed in claim 4,.wherein said conductivity control agent is finely-divided tin oxide particles.

6. The electrophotographic photoconductor as claimed in claim 1,.further comprising an adhesive layer which is interposed between said charge retention layer and said protective layer, said adhesive layer comprising a hardened material containing a metal alkoxide.

7. The electrophotographic photoconductor as claimed in claim 1, further comprising an adhesive layer which is interposed between said charge retention layer and said protective layer, said adhesive layer comprising a hardened material of an organic metal complex.

8. The electrophotographic photoconductor as claimed in claim 1, further comprising an adhesive layer which is interposed between said charge retention layer and said protective layer, said adhesive layer comprising a hardened material of a silan coupling agent having an isocyanate group.

9. The electrophotographic photoconductor as claimed in claim 1, further comprising an adhesive layer which is interposed between said charge retention layer and said protective layer, said adhesive layer comprising a decomposition product of silylisocyante.

10. An electrophotographic photoconductor comprising an electroconductive layer, on which are formed in order, a photoconductive layer, a charge retention layer, an adhesive layer, and a protective layer, wherein said photoconductive layer comprises an As-Se alloy of the formula of $As_xSe_{100-x}$, where x indicates the weight percentage of As in said As-Se alloy, and is in the range of 33 wt.% $\leqq x \leqq 38$ wt.%: said charge retention layer comprises a silicone resin comprising (a) 50 wt.% to 80 wt.% of silicone and oxygen, (b) 10 wt.% to 30 wt.% of carbon, (c) 1 wt.% to 10 wt.% of hydrogen, and (d) 1 wt.% to 10 wt.% of nitrogen; said adhesive layer comprises a hardened metal alkoxide compound; and said protective layer comprises a binder resin prepared by the reaction of (i) a copolymer of styrene - methyl methacrylate and 2-hydroxyethylmethacrylate, in which the content the 2-hydroxyethylmethacrylate is 15 to 45 wt.%, and (ii) an isocyanate compound, and a conductivity control agent dispersed in said binder resin.

11. The electrophotographic photoconductor as claimed in claim 10, wherein said conductivity control agent is finely-divided tin oxide particles.

* * * * *

UNITED STATES PATENT AND TRADEMARK OFFICE

CERTIFICATE OF CORRECTION

PATENT NO. : 4,957,839

DATED : September 18, 1990

INVENTOR(S) : Rokutanzono et al.

It is certified that error appears in the above-identified patent and that said Letters Patent is hereby corrected as shown below:

Column 1, line 9, "electro-photo-" should read --electrophoto--- line 15, after "photoconductor" insert --,-- line 33, "noncrystalline" should read --non-crystalline-- line 33, insert new paragraph beginning with "At the"

Column 3, line 43, "a" should read --an-- line 56, "additional" should read --addition--

Column 5, line 2, "Aλ" should read --Al-- line 5, "Aλ" should read --Al-- line 13, "Aλ" should read --Al--

Column 7, line 59, "hydrogenerted" should read --hydrogenerated--

Column 9, line 40, "zine" should read --zinc--

UNITED STATES PATENT AND TRADEMARK OFFICE

CERTIFICATE OF CORRECTION

PATENT NO. : 4,957,839

DATED : September 18, 1990

INVENTOR(S) : Rokutanzono et al.

It is certified that error appears in the above-identified patent and that said Letters Patent is hereby corrected as shown below:

Column 10, line 27, "bisacetylacetonatc" should read --bisacetylacetonate--

Column 11, line 32, "(ii)" should read --(iii)--

Column 12, line 19, "electro-photographic" should read --electrophotographic--

Column 13, line 18, "drycleaing" should read --drycleaning--

Column 14, line 57, after "Table," insert --O--

Column 16, line 48, "(ii)" should read --(iii)-- line 51, after "bonded." begin new paragraph starting with "The above charge"

UNITED STATES PATENT AND TRADEMARK OFFICE

CERTIFICATE OF CORRECTION

PATENT NO. : 4,957,839

DATED : September 18, 1990

INVENTOR(S) : Rokutanzono et al.

It is certified that error appears in the above-identified patent and that said Letters Patent is hereby corrected as shown below:

Column 17, line 33, before "an" insert --by--, change "adheisve" to read --adhesive-- line 51, before "an" insert --by--, change "adheisve" to read --adhesive--

Column 17, line 65, before "an" insert --by--, change "adheisve" to read --adhesive--

Column 18, line 11, before "an" insert --by-- line 26, before "an" insert --by--, change "adheisve" to read --adhesive-- line 40, before "an" insert --by--, change "adheisve" to read --adhesive--

Column 19, line 22, change "abovemen-tioned" to read --above-mentioned-- line 29, change "photo-conductor" to read --photoconductor--

UNITED STATES PATENT AND TRADEMARK OFFICE

CERTIFICATE OF CORRECTION

PATENT NO. : 4,957,839

DATED : September 18, 1990

INVENTOR(S) : Rokutanzono et al.

It is certified that error appears in the above-identified patent and that said Letters Patent is hereby corrected as shown below:

Column 20, line 40, change "silylisocyante" to read --silylisocyanate--

Signed and Sealed this

Twentieth Day of October, 1992

*Attest:*

*Attesting Officer*

DOUGLAS B. COMER

*Acting Commissioner of Patents and Trademarks*